United States Patent [19]

Kegan et al.

[11] Patent Number: 4,995,592

[45] Date of Patent: Feb. 26, 1991

[54] PURIFYING MOLTEN METAL

[75] Inventors: Neil J. Kegan, Birmingham; Ian Hitchens, Middlesborough; Thomas Robertson, Stockton, all of England; Paul A. Whitehouse, Whyalla Playford, Australia

[73] Assignees: Foseco International Limited, Birmingham; British Steel PLC, London, both of England

[21] Appl. No.: 446,567

[22] Filed: Dec. 5, 1989

[30] Foreign Application Priority Data

Dec. 22, 1988 [GB] United Kingdom ..... 8829918
May 20, 1989 [GB] United Kingdom ..... 8911682

[51] Int. Cl.[5] ..... C21B 7/14

[52] U.S. Cl. ..... 266/44; 266/229; 266/275

[58] Field of Search ..... 266/44, 229, 275; 164/337, 437, 335

[56] References Cited

U.S. PATENT DOCUMENTS 4,770,395 9/1988 Vo Thanh et al. ..... 266/275
4,776,570 10/1988 Vo Thanh et al. ..... 266/44

FOREIGN PATENT DOCUMENTS 124667 11/1984 European Pat. Off. .
239257 9/1987 European Pat. Off. .
59-189050 10/1984 Japan .
62-46267 10/1987 Japan .
12909362-A 2/1986 U.S.S.R. .
835084 5/1960 United Kingdom .
1267942 3/1972 United Kingdom .
1271021 4/1972 United Kingdom .
1313736 4/1973 United Kingdom .
1313737 4/1973 United Kingdom .
1386174 3/1975 United Kingdom .
1391845 4/1975 United Kingdom .
4467024 3/1977 United Kingdom .
1478639 7/1977 United Kingdom .

*Primary Examiner*—S. Kastler
*Attorney, Agent, or Firm*—Nixon & Vanderhye

[57] ABSTRACT

The invention relates to a means of purifying molten metal, particularly steel, by the removal of impurities-/inclusions during continuous casting.

The molten metal (3) is passed in a tundish (1) through a vertical array of baffles (8) that are spaced apart transversely across the tundish to provide restricted flow channels (12). The baffles (8) may be flat boards or tiles (9*a*, 9*b*) and are preferably used in contact with a weir (7) and dam (10), upstream and downstream respectively of the baffles.

The speed and direction of flow of the molten metal can thereby be controlled and directed to give more effective dwell time in contact with a surface covering layer (11) of flux.

26 Claims, 4 Drawing Sheets

PURIFYING MOLTEN METAL

This invention relates to a method and apparatus for purifying molten metal and is particularly applicable to purifying molten steel during the continuous casting process. For convenience the invention will hereafter be described with reference to steel only.

In the continuous casting of steel, molten steel is poured from a ladle into a continuous casting mould via an intermediate vessel which acts as a constant head reservoir and is called a tundish.

It is usual to treat the steel as initially "inclusions" includes indigenous and exogenous produced at a stage before it is in the ladle and/or whilst it is in the ladle in order to remove undesired impurities or inclusions prior to pouring the steel into a tundish. These treatments are generally referred to collectively as secondary steel-making processes, which include ladle slag removal, vacuum treatment, inert gas stirring, fluxing treatments or inert gas injection of powder reagents.

Furthermore, two or more of these processes may be combined in order to achieve high quality steels having particular regard for steel cleanness. However, a proportion of impurities, whether solid or liquid, always pass from the ladle to the tundish. In addition further inclusions e.g. oxide inclusions, may result from atmospheric oxidation of the molten steel as it flows from a ladle to a tundish.

There is also a tendency for the steel to pick up further impurities in the tundish and it has generally proven difficult and also rather costly to remove impurities from steel in a tundish although cover slags are some use in this respect. Moreover, once the steel has passed from the tundish into the mould it is difficult to remove impurities despite the limited effect that may be achieved by use of suitable mould fluxes.

It is understood that the expression "inclusions" includes indigenous and exogenous inclusions and furthermore the inclusions may be separate or in clusters. In any event, inclusions in the steel in the tundish can be harmful as a result of being deposited in the bore of the outlet nozzles including any extension thereof below the tundish extending towards the moulds or as a result of being transferred into the moulds where they may cause a deterioration in surface and internal quality and adversely affect the metallurgical properties of the steel being cast.

The present invention provides an effective means of reducing the inclusion content of steel leaving a tundish.

Accordingly, the invention provides in a first aspect, a method of purifying metal comprising passing the molten metal in a tundish past and between a vertical array of baffles located between the zone of arrival of the metal in the tundish from the ladle and an outlet from the tundish, the baffles of the array being spaced apart transversely across the tundish whereby flow of the molten metal is restricted to channels between the baffles.

In a second aspect the invention provides a tundish containing a vertical array of baffles between the arrival zone for molten metal and an outlet, the baffles of the array being spaced apart transversely across the tundish to provide flow channels between the baffles.

The baffles may be formed from any refractory or ceramic materials which are suitable for use in contact with molten steel e.g. formed from a high alumina containing particulate refractory bonded by e.g. a refractory cement. Alternatively, the baffles may be formed from suitable refractory materials and fired at high temperature prior to use.

The ceramic of the baffles may be a porous or cellular ceramic e.g. in the form of a cellular ceramic foam or in the form of an extruded cellular ceramic. In another embodiment of the invention the ceramic of the baffles may be substantially solid or they may be a combination of cellular and solid ceramic.

The baffles may be flat e.g. boards, or tiles or, for example, shaped so as to define a tortuous, e.g. zig-zag, path. The tiles are preferably generally parallel and equidistant one to another which arrangement is particularly effective in controlling the flow velocity of the steel which in turn, enhances the separation of the inclusions passing through and between the baffles and subsequently when the steel contacts an inclusion absorbing flux.

In an alternative embodiment the array of baffles may be formed or may comprise of one or more portions of an extruded tubular or cellular body extending substantially from the floor of a tundish to the surface of any molten steel contained therein. Each tubular body may have one or more bores extending therethrough. The cross sectional area of the bores may be circular, square or any other suitable geometric shape. Thus in this embodiment the array of baffles may be provided not as a series of separate articles but by a unitary body suitably constructed to provide the required flow channels.

The steel passes through and/or between the baffles which can themselves be valuable in picking up and retaining inclusions from the steel. The molten steel-contacting surfaces of the baffles may be smooth. More preferably, however, their surfaces may be roughened or suitably shaped to enhance the absorption of impurities.

The inclusions which may be removed include, for example, aluminates, silicates, other oxides, sulphides, nitrides and carbides or combinations thereof.

Cellular ceramic baffles provide a relatively large surface area contacted by the steel and are particularly effective for removing alumina inclusions.

By use of an array of baffles according to the present invention, molten steel passing through the restricted width of the tundish between the baffles is thereby forced to increase its speed and this, particularly in conjunction with constraints to move the flow upwardly into contact with a surface-covering flux layer, can greatly improve the removal of inclusions. It will be appreciated that the speed of flow having increased through the baffles will gradually decrease and the direction of flow will change to horizontal and then downward, giving a more effective dwell time in contact with a surface covering layer of flux.

Preferably, the array of baffles is used in conjunction with a dam and weir arrangement and, preferably, this arrangement is in contact with or is in close proximity to the array.

Thus, in a preferred embodiment, there is positioned immediately downstream, of, and preferably in contact with the lower portions of, the baffles, a dam extending transversely across the floor of the tundish and over which the molten steel flows. The dam may extend across the entire width or a substantial portion of the width of the tundish. Additionally, there may be positioned immediately upstream of, and preferably in contact with the upper portions of, the baffles, a weir under which the molten steel flows. The weir may extend across the entire width or a substantial portion of the width of the tundish.

As indicated above, these arrangements are particularly advantageous in further increasing the velocity of the steel as it travels through the baffles since the effective cross-sectional area is reduced which in turn imparts an increase in steel velocity. The increase in velocity together with the change in flow direction produced are particularly beneficial in ensuring that any inclusions are directed towards the covering flux.

In one particular embodiment of the invention the array of baffles is used in conjunction with a tundish which has at least one internal protuberance located in a longitudinal sidewall of the tundish. The array of baffles is preferably positioned adjacent the protuberance and, in an especially preferred embodiment, a pair of protuberances is provided opposite each other across the tundish and the array of baffles is located between the pair, i.e. in the thus narrowed portion of the width of the tundish. In this latter arrangement, the outer baffle adjacent each protuberance may actually abut the protuberance or be spaced apart from it.

It will appreciated that the arrangement just described causes further restriction to the flow of steel through the tundish, thereby further increasing the speed of flow in that area.

The protuberant portions of the sidewalls may be utilised in conjunction with the use of dams and weirs in addition to the array of baffles, in the manner previously indicated.

Furthermore, the steel flow may be distributed substantially homogeneously for the full width of the tundish. In this connection the upstream and/or the downstream lateral surfaces of the protuberant portion(s) may be shaped e.g. bevelled, cambered, chamfered, radiused, rounded or otherwise profiled. Typically, the cross-section of a protuberant portion of the invention may have a trapezoidal or semicircular shape. The baffles may also be shaped such that the upstream facing and/or the downstream facing edges of the baffles define a smaller cross-sectional area than the remainder of the baffles.

The protuberant portion(s) may be formed from any refractory or ceramic materials which are suitable for use in contact with molten steel e.g. formed from a high alumina containing particulate refractory bonded by e.g. a refractory cement. Alternatively, the protuberant portion(s) may be formed from suitable refractory materials and fired at high temperature prior to use. Furthermore, the protuberant portion may be formed integrally with the permanent lining of a tundish or with a replaceable expendable lining of a tundish typically formed of a set of boards of refractory, heat-insulating material or a monolithic lining of such material. In the context of the present invention the term monolithic includes a lining formed by vibrating, gunning, spraying or casting a suitable paste, slurry or mass of refractory material.

The protuberant portion(s) preferably extend from the floor of a tundish to a height above the level to which the tundish is usually filled with molten steel. A tundish according to the invention may comprise a protuberant portion located in each longitudinal side wall and preferably said portions are diametrically opposed. In addition, a tundish may include a protuberant portion in the floor. A plurality of juxtaposed pairs of protuberances may be used.

The protuberant portion may have a hollow form e.g. made in the manner of a box from a set of boards or tiles. The protuberant portion or portions reduce the free flow area of a tundish which arrangement is particularly effective in controlling the velocity of the steel which in turn enhances the separation of the inclusions passing through and between the portions and subsequently when the steel contacts an inclusion absorbing flux e.g. covering the steel in the tundish.

Known methods of removing inclusions in a tundish e.g. using dams and weirs, are not wholly effective and generally are only capable of removing those inclusions greater than about 100 μm. However, this performance is inadequate for steels destined for use in, for example, the manufacture of drawn and wall-ironed products for which case the inclusion size limit is generally about 50 μm.

The method and apparatus of the present invention is able to reduce inclusions exceeding 10 μm, which is a most satisfactory result.

The improvements achieved by the arrangement of baffles of the invention serve to separate the inclusions from the steel in the following manner:

(i) surface adsorption or filtration of inclusions onto the surface of the baffle boards, tiles or other shapes.

(ii) formation of a generally upward flow of steel having a higher velocity initially and having a lower velocity at the covering flux/liquid steel interface together with a substantially horizontal steel flow at said interface, maximises the inclusion separation by flotation and subsequent capture by the inclusion absorbing flux.

In the method and apparatus of the invention means may be incorporated for introducing inert and/or non-oxidising gases into the steel integrally with the array or adjacent thereto. For example, this maybe achieved by means of the array having a gas-permeable portion through which gas can pass outwardly into the steel and ducting for the supply of gas to the gas-permeable portion. Alternatively, known gas-purging means used in tundishes may be employed.

In addition to the arrangements described above, one or more baffles, dams and/or weirs may, if desired, be positioned in the downstream zone of a tundish.

The invention is further described with reference to the accompanying drawings in which.

Figure 1:
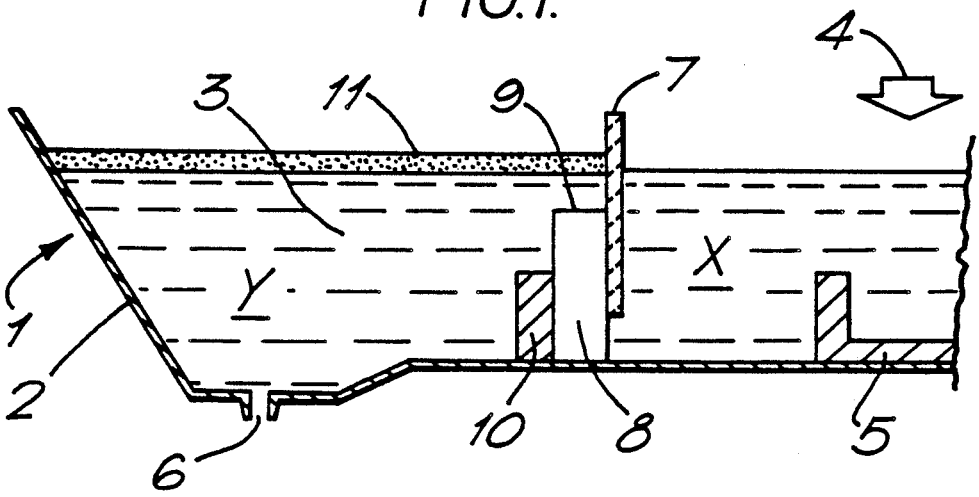
FIG. 1 is half of a symetrical tundish, sectioned along its length, in accordance with one embodiment of the invention.

Referring now to FIG. 1 a tundish assembly 1 has an outer metal casing 2 and an inner refractory lining (not shown) containing molten steel 3. A stream 4 of molten steel 3 is introduced to the tundish 1 via an impact zone 5.

In relation to the general direction of flow of steel through the tundish, X signifies the upstream side i.e. the side nearer the zone of entry of steel into the tundish and Y the downstream side i.e. the side nearer an outlet nozzle 6 from which the steel exits the tundish.

A refractory board 7 serves as a partition which is suspended between the upstream and downstream zones of the tundish and which in addition acts as a partial barrier of the upper part of the upstream side of baffles 8. The baffles consist of a plurality of equidistant vertical disposed ceramic tiles 9 (only the side of one tile being visible.) The lower part of the array 8 on the downstream side has a barrier wall 10. In use this arrangement produces an upward flow of steel passing between the ceramic tiles 9 and directs the steel towards a surface layer of inclusion-absorbing flux 11 prior to the steel leaving the tundish via a nozzle 6.

Figure 2:
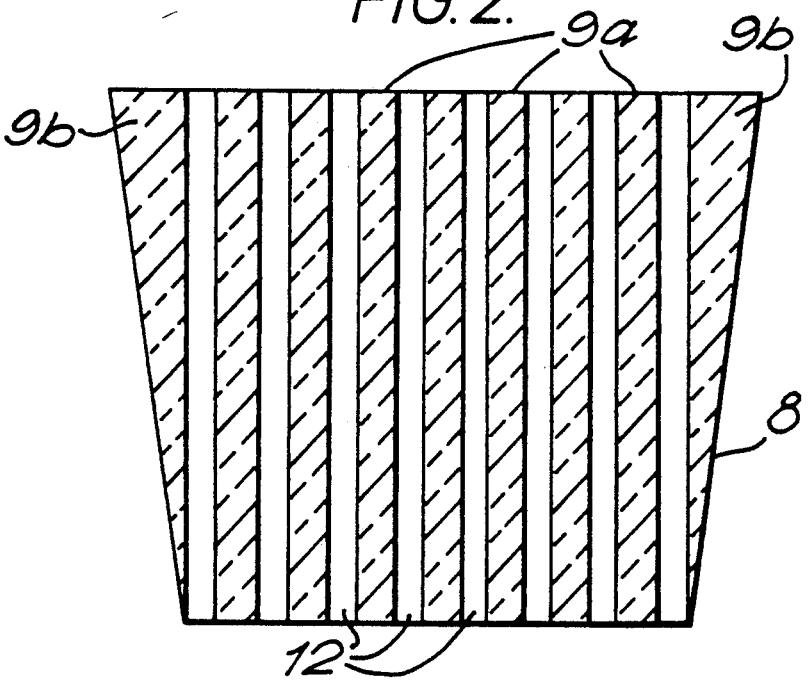
FIG. 2 is an enlarged vertical section viewed from the downstream side of an array of ceramic baffles schematically indicated in FIG. 1.

The array 8 comprising a plurality of ceramic tiles 9 indicated only schematically in FIG. 1 is an array having the structure shown diagramatically in FIG. 2. Thus, the array 8 has nine vertically disposed ceramic tiles *9a*, *9b* placed substantially equidistantly apart across the width of a tundish. The total area of the channels 12 formed between the tiles *9a*, *9b*, define the free flow area of the tundish through the array.

Figure 3:
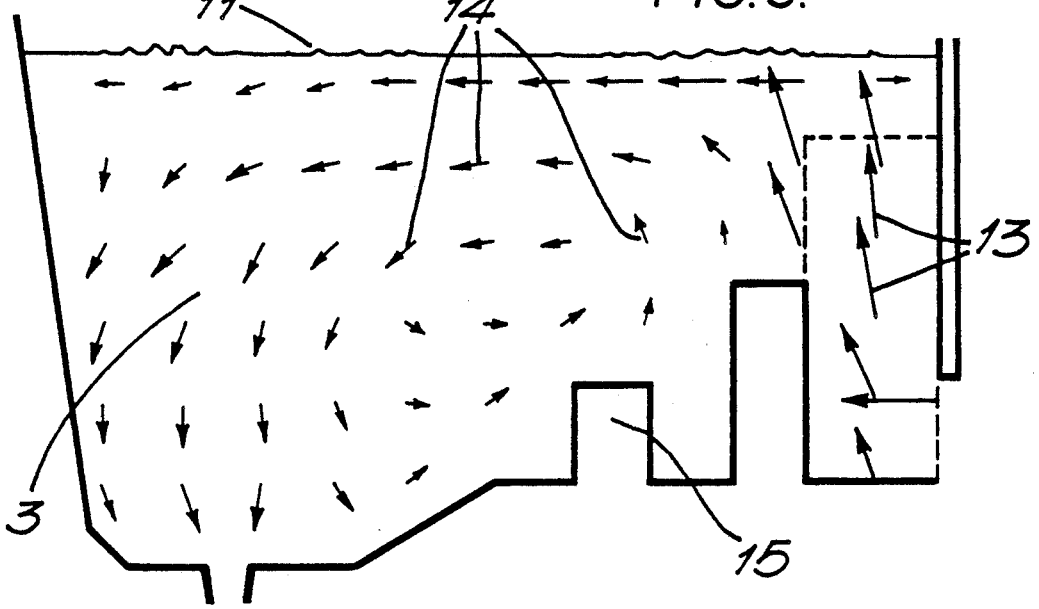
FIG. 3 is a schematic vertical section along the length of part of a tundish to show the velocity vectors produced in the tundish.

Referring now to FIG. 3, the velocity vectors produced in a tundish according to this invention are shown by long-tailed arrows 13 and shorter-tailed arrows 14. The optional use of a downstream dam 15 is also shown. The arrows 13 depict zones of increased velocity and arrows 14 show zones of lower velocity.

In use the lower velocity is particularly advantageous as indicated at the interface between the molten steel 3 and the inclusion absorbing flux 11 as the change of velocity accompanied by a change in direction enables significant amounts of sub 100 $\mu$m inclusions to be removed.

Figure 4:
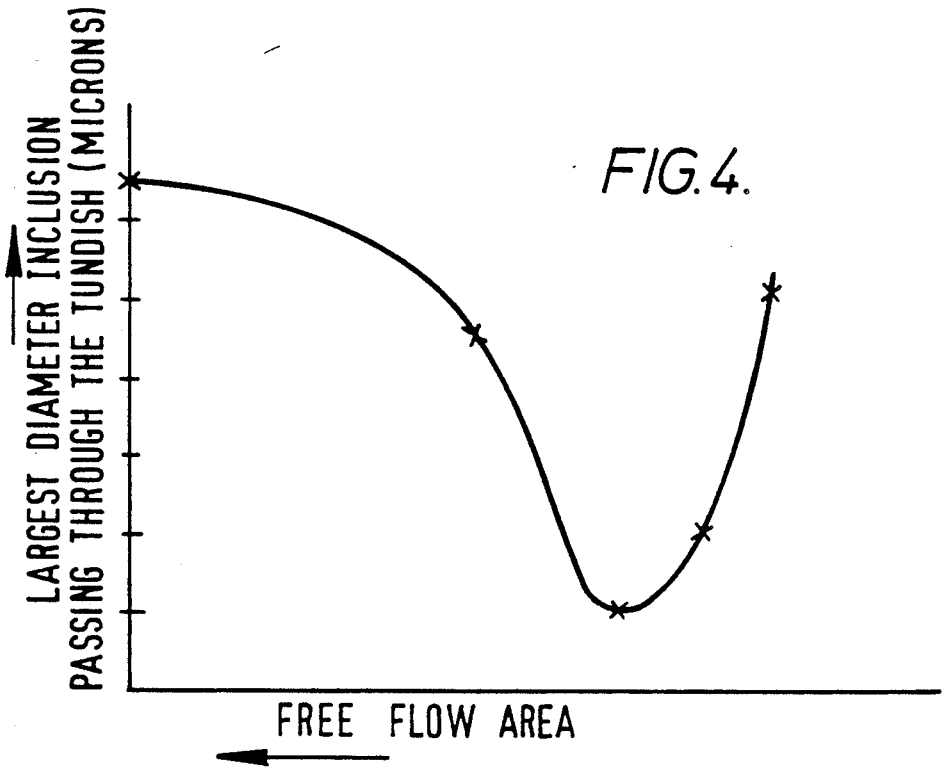
FIG. 4 is a graphical representation illustrating the relationship between the maximum inclusion size passing through a tundish and the free flow area defined by the array of FIG. 2.

As can be seen from FIG. 4, the ability of the system to remove inclusions at first increases with decrease of free flow area through the baffles and then passes an optimum point after which the ability decreases and, clearly, the best arrangement for any particular embodiment of the invention will be determinable by the skilled man of the art.

Figure 6:
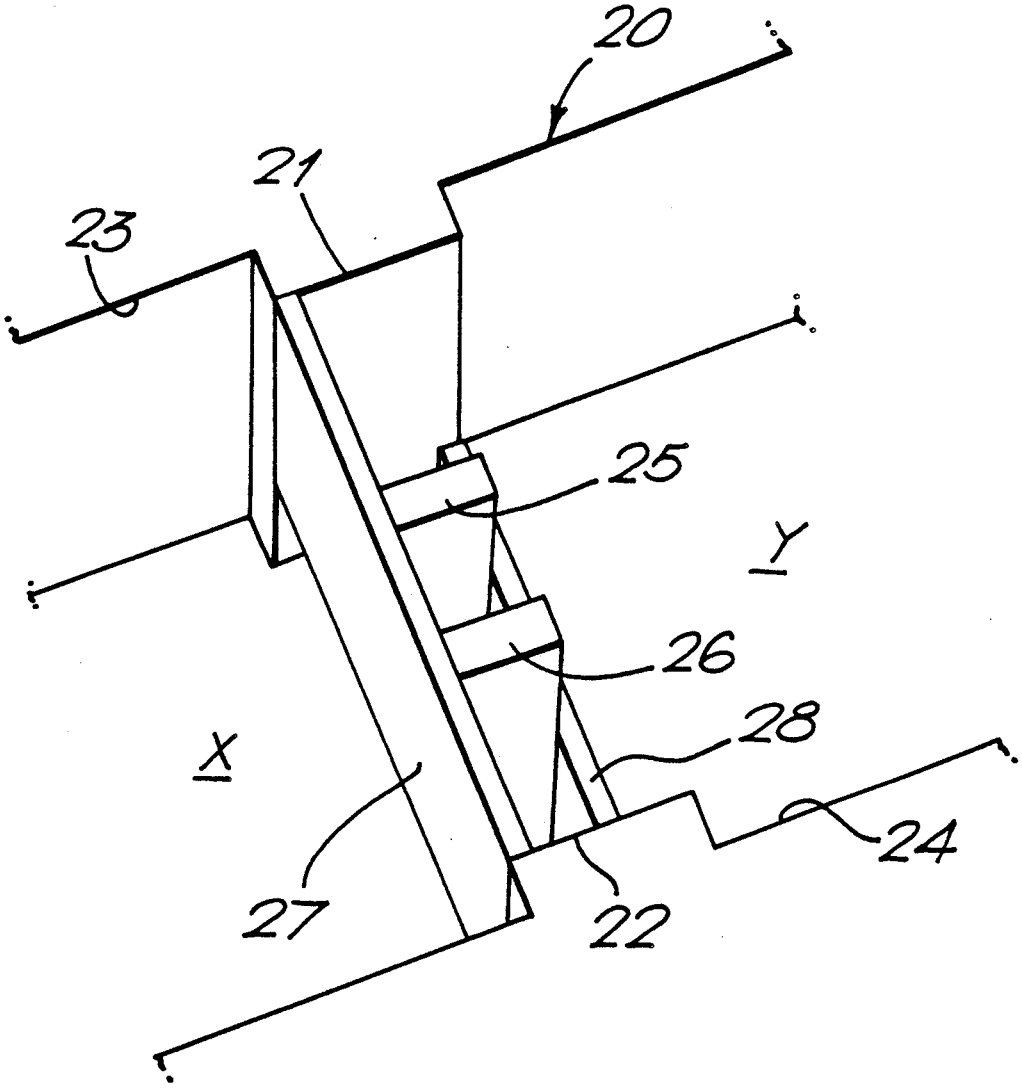
FIG. 6 is a perspective view of a portion of a tundish in accordance with a further embodiment of the invention.

In FIG. 6, a tundish 20 has a pair of internal protuberances 21 and 22 opposed across its width, one being in each longitudinal sidewall 23 and 24 respectively.

Positioned between the opposed protuberances 21 and 22 in the thus narrowed region of the tundish is a pair of vertically-disposed substantially parallel baffles 25 and 26.

Immediately on the upstream side X of the tundish and in contact with baffles 25 and 26 is a weir 27 extending fully across the narrowed region of the tundish between protuberances 21 and 22.

Immediately on the downstream side Y of the tundish and also in contact with baffles 25 and 26 is a dam 28 also extending fully across the narrowed region of the tundish between protuberances.

In use, molten steel flowing through the tundish will pass underneath weir 27 and its speed will be increased by the constriction of its flow path due to the protuberances 21 and 22 and also by the restriction into channels around baffles 25 and 26. The steel at increased speed will then be forced to flow upwardly over dam 28 and hence directed towards a slag layer provided on the molten metal surface.

It will be appreciated that many modifications to the above-described specific embodiments can be made within the scope of the invention. For example, in respect of the FIG. 6 embodiment, it is not essential that weir 27 or 28 dam extend between the protuberances 21 and 22. They could be offset from the protuberances and extend across the full unrestricted width of the tundish.

EXAMPLE

Figure 5:
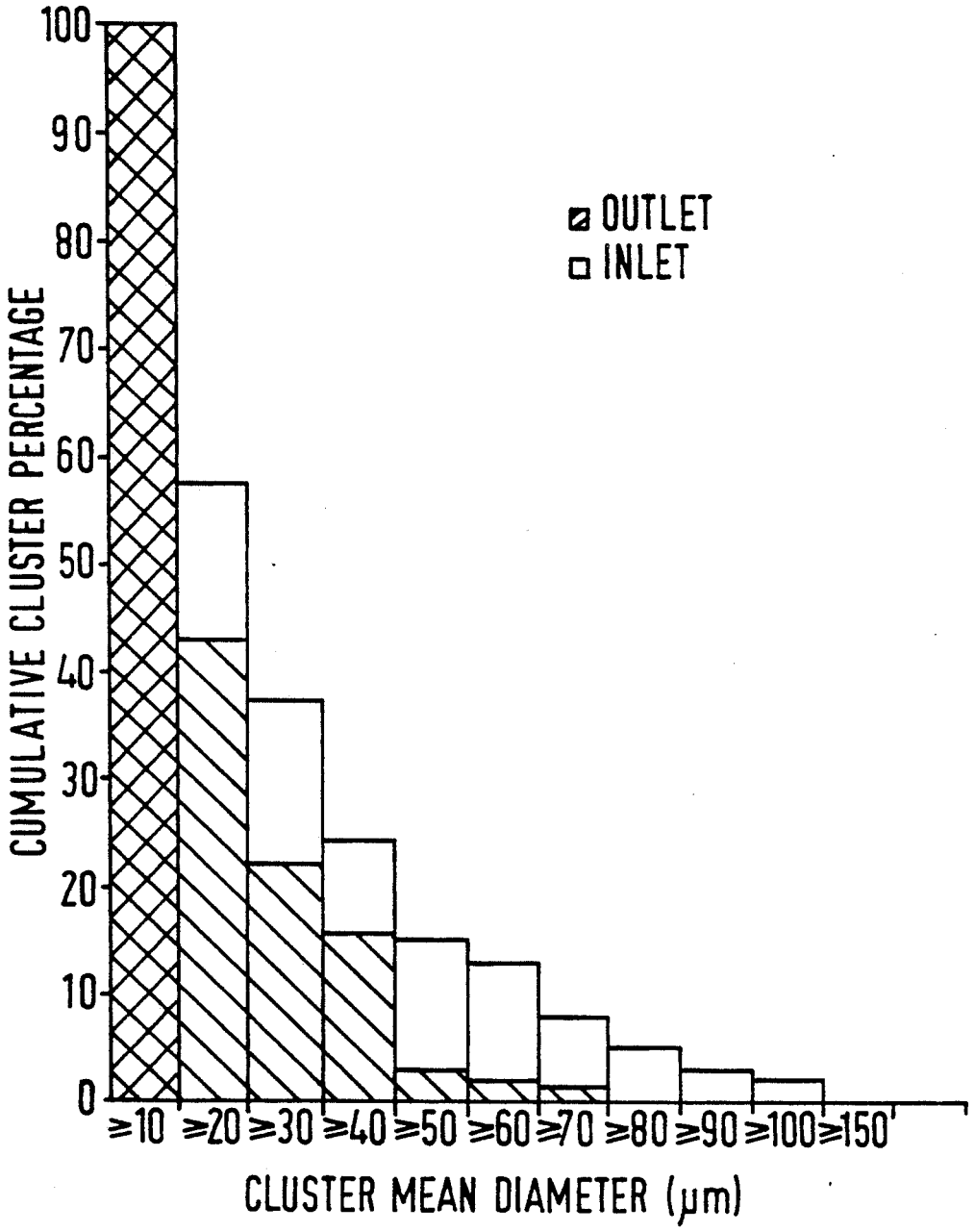
FIG. 5 is a diagram showing the inclusion size distribution at the inlet and the outlet from a tundish equipped in accordance with the invention.

In a large scale laboratory experimental evaluation a tundish having a capacity of 600 kg was used. The exit nozzle had a nominal diameter of 26 mm. A vertical array of ceramic tiles was introduced into the tundish and arranged substantially in the manner as illustrated in FIG. 1. This assembly was used to cast an ingot weighing approximately 3500 kg. A series of dip samples were taken at regular intervals from both the upstream and downstream zones of the tundish throughout the duration of the casting cycle which lasted for 330 seconds. The results from these samples are shown in FIG. 5 which relates to an alumina cluster count for each sample from the inlet (unfiltered) and outlet (filtered) zones of the tundish. The total alumina ($Al_2O_3$) cluster area was calculated for each sample and the mean value determined.

The filtered results are significantly better than the unfiltered (inlet) ones showing that the tundish assembly of the present invention and its methods of its use are most satisfactory.

We claim:

1. A method of purifying metal in a tundish comprising passing said metal in molten form between a zone of arrival and an outlet and past baffles located between said zone of arrival and outlet, in which the metal is passed past and between a vertical array of said baffles, the baffles of the array being spaced apart transversely across the tundish whereby flow of the molten metal is restricted to channels between the baffles; and wherein there is positioned immediately upstream of the array of baffles a weir extending transversely across the tundish for at least a substantial portion of its width and under which the metal must flow.

2. A method of purifying metal in a tundish having a zone of arrival and an outlet, with a vertical array of baffles located between the zone of arrival and outlet, the baffles of the array being spaced apart transversely across the tundish so that flow of the molten metal is restricted to channels between the baffles; said method comprising the steps of passing molten metal between the zone of arrival and outlet past and between the baffles so that the metal increases its speed as it moves past the baffles, the speed increase enhancing the removal of inclusions from the molten metal.

3. A method according to claim 2, in which there is positioned immediately downstream of the array of baffles a dam extending transversely across the floor of the tundish for at least a substantial portion of its width and over which the metal must flow.

4. A method according to claim 2, in which the baffles are tiles shaped to define a tortuous path.

5. A method according to claim 2, in which at least one further baffle, dam or weir is positioned downstream from the array of baffles.

6. A method of purifying metal in a tundish comprising passing said metal in molten form between a zone of arrival and an outlet and past baffles located between said zone of arrival and outlet, in which the metal is passed past and between a vertical array of said baffles, the baffles of the array being spaced apart transversely across the tundish whereby flow of the molten metal is restricted to channels between the baffles and wherein the baffles are flat tiles.

7. A method according to claim 6, in which the tiles are positioned parallel to each other.

8. A method according to claim 6, in which the tiles are equidistant from each other.

9. A method of purifying metal in a tundish comprising passing said metal in molten form between a zone of arrival and an outlet and past baffles located between said zone of arrival and outlet, in which the metal is passed past and between a vertical array of said baffles, the baffles of the array being spaced apart transversely across the tundish whereby flow of the molten metal is restricted to channels between the baffles and wherein the array of baffles is in the form of a unitary body of extruded tubular or cellular form extending from the floor of the tundish to the surface of any molten metal contained therein.

10. A method of purifying metal in a tundish comprising passing said metal in molten form between a zone of arrival and an outlet and past baffles located between said zone of arrival and outlet, in which the metal is passed past and between a vertical array of said baffles, the baffles of the array being spaced apart transversely across the tundish whereby flow of the molten metal is restricted to channels between the baffles and wherein the tundish has at least one internal protuberance in its longitudinal sidewalls, the array of baffles being located adjacent the protuberance in its longitudinal sidewalls, the array of baffles being located adjacent the protuberance.

11. A method according to claim 10, in which the protuberance extends from the floor of the tundish to a height above the level to which the tundish is filled with molten metal.

12. A method according to claim 10, in which there is a pair of opposed protuberances one in each longitudinal sidewall the array of baffles being located between them.

13. A tundish comprising:

a floor and sidewalls an arrival zone for molten metal and outlet for molten metal; and a vertical array of baffles located between said arrival zone and said outlet, the baffles of the array being spaced apart transversely across the tundish to provide restricted flow channels between the baffles, and comprising means for increasing the velocity of molten metal flowing therepast and therebetween.

14. A tundish according to claim 13, in which the baffles are of a high alumina ceramic material containing refractory particulates bonded by refractory cement.

15. A tundish according to claim 13 in which immediately on the downstream side of the array of baffles is a dam extending transversely across the floor of the tundish for at least a substantial portion of its width.

16. A tundish according to claim 13, in which the baffles are flat tiles which are parallel to each other.

17. A tundish according to claim 13, in which baffles are tiles which are equidistant from each other.

18. A tundish according to claim 13, which contains at least one further baffle, dam or weir downstream from the array of baffles.

19. A tundish according to claim 13, which has at least one internal protuberance in its longitudinal sidewalls the array of baffles being adjacent the protuberance.

20. A tundish comprising:

a floor and sidewalls, and an arrival zone and outlet for molten metal;

a vertical array of baffles located between said arrival one and the outlet, the baffles of the array being spaced apart transversely across the tundish to provide flow channels between the baffles; and a weir extending transversely across the tundish for at least a substantial portion of its width immediately on the upstream side of the array of baffles.

21. A tundish comprising:

a floor and sidewalls, and an arrival zone and outlet for molten metal;

a vertical array of baffles located between said arrival one and the outlet, the baffles of the array being spaced apart transversely across the tundish to provide flow channels between the baffles;

said array of baffles being in the form of unitary body of extruded tubular or cellular form extending from the floor of the tundish.

22. A tundish comprising:

a floor and longitudinal sidewalls, and an arrival zone and outlet for molten metal;

a vertical array of baffles located between said arrival one and the outlet, the baffles of the array being spaced apart transversely across the tundish to provide flow channels between the baffles; and at least one internal protuberance in said longitudinal sidewalls, the array of baffles being adjacent said at least one protuberance.

23. A tundish according to claim 22, in which the protuberance extends from the floor of the tundish to a height above the level to which the tundish is to be filled with molten metal.

24. A tundish according to claim 22 in which there is a pair of opposed protuberances one in each longitudinal side wall, the array of baffles being located between them.

25. A tundish according to claim 21, in which the protuberance is formed integrally with a permanent or expendable lining of the tundish.

26. A tundish according to claim 21, in which the protuberance is in the form of a box made from a set of boards or tiles.

* * * * *

UNITED STATES PATENT AND TRADEMARK OFFICE

CERTIFICATE OF CORRECTION

PATENT NO. : 4,995,592

DATED : Feb. 26, 1991

INVENTOR(S) : Kegan et al

It is certified that error appears in the above-identified patent and that said Letters Patent is hereby corrected as shown below:

column 1, lines 13-14, after "initially" delete ""inclusions" includes indigenous and exogenous"

column 4, line 29, after "inclusion " insert -- - -- (a hyphen)

column 7, lines 33-34, after "sidewalls" delete "the array of baffles being located adjacent the protuberance".

Claim 22, column 8, Line 38, "one" should be --zone--.

Signed and Sealed this

Twenty-second Day of September, 1992

*Attest:*

DOUGLAS B. COMER

*Attesting Officer*

*Acting Commissioner of Patents and Trademarks*